United States Patent [19]

Cliborn

[11] Patent Number: 4,860,468

[45] Date of Patent: Aug. 29, 1989

[54] WINDOWED MATRIX DISPLAY FOR BASEBALL CARDS AND SIMILAR OBJECTS

[76] Inventor: David L. Cliborn, 23035 Nicolle Ave., Carson, Calif. 90745

[21] Appl. No.: 114,553

[22] Filed: Oct. 29, 1987

[51] Int. Cl.[4] ..... G09F 1/00

[52] U.S. Cl. ..... 40/124.2; 40/159

[58] Field of Search ..... 40/124.2, 156, 359, 40/124.4, 159, 405; 229/72

[56] References Cited

U.S. PATENT DOCUMENTS

| | | | |
|---|---|---|---|
| 1,549,118 | 8/1925 | Harvey | 40/159 |
| 2,041,756 | 5/1936 | Gray | 40/124.2 |
| 2,127,940 | 8/1936 | Rinn | 40/159 |
| 2,253,814 | 8/1941 | Sames | 40/159 |
| 2,775,050 | 12/1956 | Ellsworth | 40/124.2 |
| 2,844,901 | 7/1958 | Elsen | 40/158.1 |
| 2,861,370 | 11/1958 | McArthur | 40/159 |
| 3,371,439 | 3/1968 | Smith | 40/156 |
| 4,419,837 | 12/1983 | Meeker | 40/124.2 |

*Primary Examiner*—Robert Peshock
*Attorney, Agent, or Firm*—Lee W. Tower

[57] ABSTRACT

A windowed display for displaying baseball cards and similar flat objects that has a front panel having a matrix of cutouts which are smaller in area than the flat objects to be displayed, an intermediate panel having a corresponding matrix of cutouts which are larger in area than the cutouts on the front panel and larger in area than the flat objects to be displayed and a rear panel having a corresponding matrix of slots wider and much shorter than the corresponding width and height of the cutouts on the intermediate panel so that when the front, intermediate and rear panels are attached to one another they form a matrix of display vaults that can be filled by inserting flat objects through the slots in the rear panel and so that the front of the flat objects are viewable through the cutouts in the front panel. An optional transparent rear panel allows the rear of the flat objects to be viewable through the rear panel.

3 Claims, 1 Drawing Sheet

FIG. 1
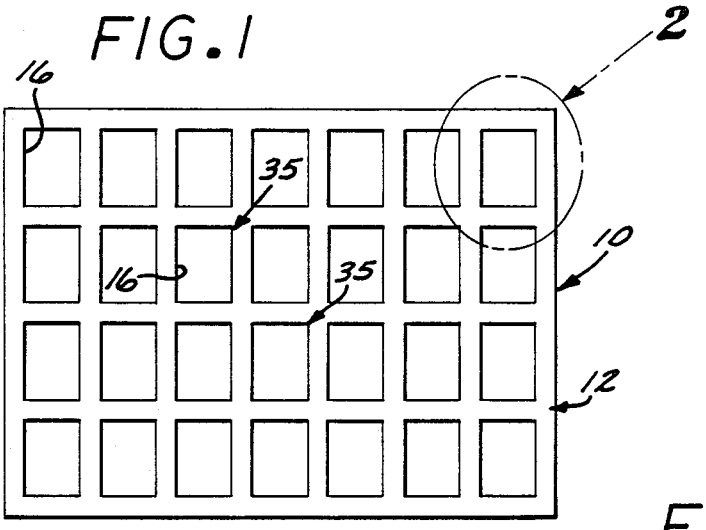
FIG. 6
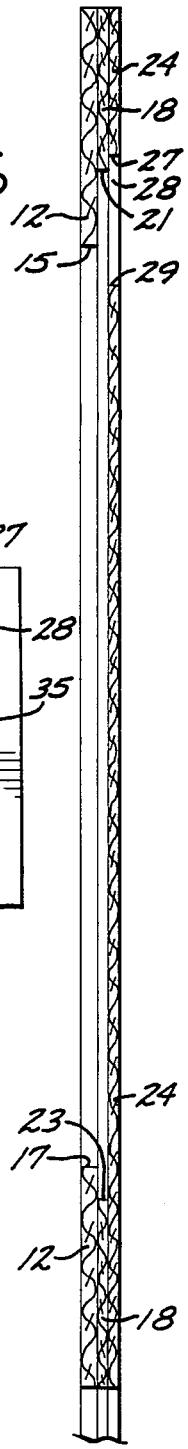
FIG. 2
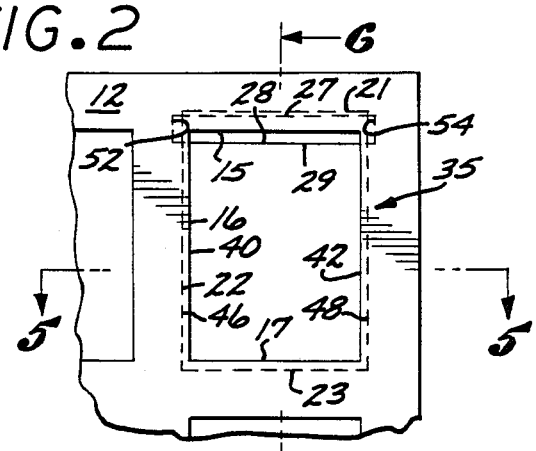
FIG. 3
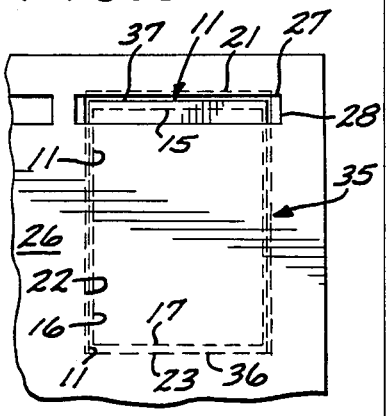
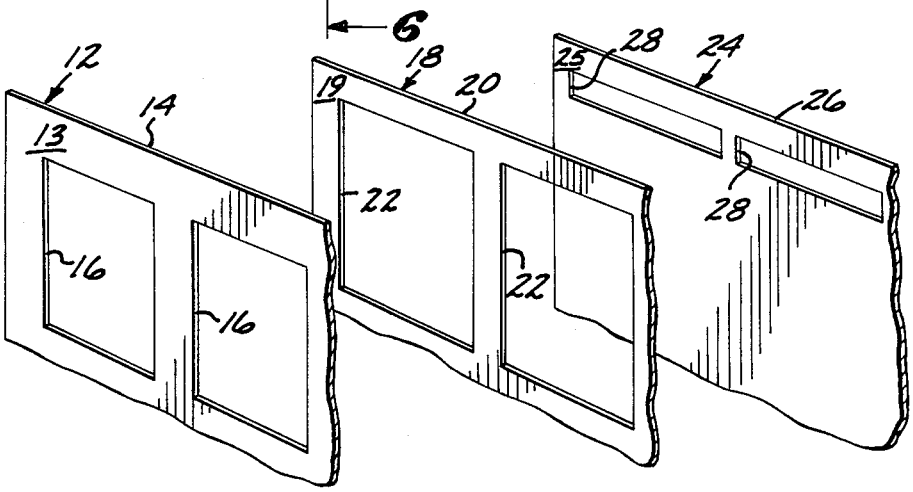
FIG. 4
FIG. 5
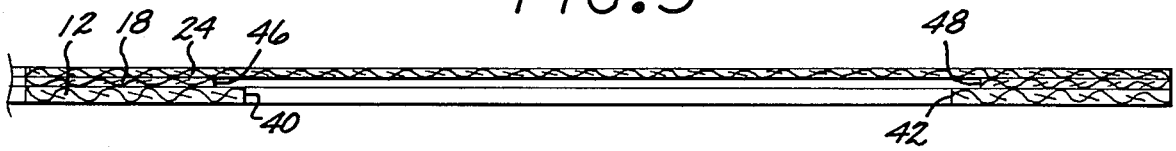

WINDOWED MATRIX DISPLAY FOR BASEBALL CARDS AND SIMILAR OBJECTS

BACKGROUND OF THE INVENTION

1. Field of the Invention

The present invention relates to windowed displays and particularly to display matrices for displaying multiple flat objects such as baseball cards or photographs.

2. Description of the Prior Art

In the prior art various techniques have been used to display a matrix of flat objects. One technique is to employ a two panel system with the front panel having openings through which the flat objects such as photographs can be viewed. The photographs are positioned and mounted on the rear panel and then the front panel is put on top thereby framing the matrix or collage of photographs. Another technique is to use special tabs on the corners of the objects to mount the objects on a panel. Yet another technique used for albums consists of placing the photographs on a sheet of paper and then folding a slightly sticky plastic sheet over the photographs.

U.S. Pat. No. 3,371,439 to Smith describes a frame assembly having a thin rectangular matrix made of a plastic material. The matrix is fabricated so that is has a rectangular gridwork of intersecting integral ridges and panels defining compartments or trays in which rectangular cards can be placed. A flexible retaining grid is also provided, which snaps over the ridges of the matrix.

U.S. Pat. No. 2,861,371 to McArthur describes a file card structure that provides a holder for strips and/or individual frames of photographs and the like and has a transparent envelope that is insertable into a card structure provided for this purpose.

A disadvantage of all but one of the prior art display techniques is that they do not provide an attractive frameable display of the objects. The only one that is used often to achieve a frameable display is the technique that employs a two panel system with the front panel having openings through which the flat objects such as photographs mounted on a rear panel in a matrix or a collage can be viewed. There are several disadvantages of this method of display. First it is difficult to align the objects properly when mounting them on the rear panel. The result is that when the front panel is applied to the rear panel and the objects viewed, they appear skewed and crooked with respect to one another. Another disadvantage is that the displayed objects come into contact with adhesive on the front or rear panel.

Another disadvantage of the latter technique is that it does not permit one object to be changed without disturbing all the other objects in the display. Also it is not possible to view the rear of the objects unless the display is dismantled and the photograph removed.

SUMMARY OF THE INVENTION

With the above background in mind, it is among the primary objectives of the present invention to provide an improved display matrix for displaying multiple flat objects such as baseball cards or photographs. It is another object of the present invention to provide a matrix display which is attractive and frameable. Another object of this invention is to provide for the easy alignment of objects in the display matrix so that they appear properly mounted in a regular matrix. It is another object of the present invention that one object in the matrix can be changed without removing or disturbing all the other objects in the display. Another object is to allow the information on the rear of the objects to be viewed without dismantling the display or removing the objects. Another object of the invention is a display in which the objects to be viewed never come into contact with any glue, paste or tape.

These objects are accomplished by having a windowed display for displaying baseball cards and similar flat objects that has a front panel having a matrix of cutouts, with the area of each cutout slightly smaller in area than the flat objects to be displayed; an intermediate panel having a corresponding matrix of cutouts which are larger in area than the cutouts on the front panel and slightly larger than the objects to be displayed; and a rear panel having a corresponding matrix of slots wider and much shorter than the corresponding width and height of the cutouts on the intermediate panel. The front and intermediate panels are joined together and the intermediate and rear panels are joined together to form a matrix of display vaults that can be filled by inserting flat objects through the slots in the rear panel. The front of the flat objects such as photographs are viewable from the front of the display through the cutouts in the front panel.

If the rear panel is made of a transparent material then the rear of the flat objects can be viewed through the rear panel without removing them. This is especially important in the case of objects such as baseball cards which have substantial information on the rear of the card.

By providing a large enough matrix of cutouts it is possible to display a large number of photographs or baseball cards for an entire baseball team. A matrix of 4 horizontal rows by 7 vertical columns has been shown to be especially suitable since it typically allows cards for all the team players for a year plus the team manager and team leaders cards to be displayed.

The dimensions of the front and intermediate panels are designed to provide automatic alignment of the objects when they are inserted into the display through the slots in the rear panel. This automatic alignment feature and the front panel framing of the individual objects provides a very attractive and frameable display. It is possible to change one object in the matrix without removing or disturbing all the other objects in the display.

The features of the present invention which are believed to be novel are set forth with particularity in the appended claims. Other objects and many of the attendant features of this invention will be more readily appreciated as the same becomes better understood by reference to the following detailed descriptions and considered in connection with the accompanying drawings in which like reference symbols designate like parts throughout the figures.

DESCRIPTION OF THE DRAWINGS

FIG. 1 is a front view of the windowed matrix display for baseball cards and similar objects of the present invention.

FIG. 2 is a section of FIG. 1 showing, for one cutout on the front panel, dotted lines for the intermediate panel cutout and the rear panel slot.

FIG. 3 is a rear view of a section of the windowed matrix display for baseball cards and similar objects showing dotted lines for the intermediate panel cutout and the front panel cutout. Also shown is a baseball card inserted into the display.

FIG. 4 is an exploded view of the windowed matrix display for baseball cards and similar objects showing the front panel with its cutouts, the intermediate panel with its cutouts, and the rear panel with its slots.

FIG. 5 is a vertical section of FIG. 2 showing the relationships between the left and right edges of the front and intermediate panel cutouts.

FIG. 6 is a horizontal section of FIG. 2 showing the relationships between the top and bottom edges of the front and intermediate panel cutouts and the rear panel slots.

DESCRIPTION OF THE PREFERRED EMBODIMENT

The present invention is a windowed matrix display for baseball cards and similar objects 10, which is used to display baseball cards or similar objects in a matrix as shown in FIG. 1. The baseball cards are viewed through a matrix of cutouts 16 in front panel 12, which can be arranged in a four by seven matrix. Such an arrangement is sufficient to attractively display all of the cards for a baseball club's team members as well as the team manager and the team leaders for a season.

FIG. 4 is an exploded view of the windowed matrix display for baseball cards and similar objects showing the front panel 12, the intermediate panel 18 and the rear panel 24. The front panel has a matrix of cutouts 16, which are slightly smaller in area than the baseball cards or similar objects to be displayed. The intermediate panel has a corresponding matrix of cutouts 22. This corresponding matrix has the same number of cutouts as the number of cutouts in the front panel. The cutouts 22 on the intermediate panel are slightly larger than the cutouts 16 on the front panel.

The rear panel 24 has a corresponding matrix of slots 28. Again there are as many slots in the rear panel as the number of cutouts in the front panel. The slots are wider than cutouts 22 but much shorter in height.

The front panel, intermediate panel and rear panel are attached to one another to form display vaults 35, as shown in FIGS. 1, 2 and 3. This is done by attaching the planar rear side 14 of the front panel to the planar front side 19 of the intermediate panel and the planar rear side 20 of the intermediate panel to the planar front side 25 of the rear panel. The panels can be attached to one another by adhesive. Once the panels are attached together, the planar front side 13 of the front panel and the planar rear side 26 of the rear panel form the front and the rear of the windowed matrix display assembly.

FIG. 2, which is a section of FIG. 1 shows the relationship of the cutouts in the front and intermediate panel and the slots in the rear panel. The cutout 16 in front panel 12 is shown in solid lines. The cutout 22 in the intermediate panel, as shown in dotted lines, is larger in area than cutout 16 in the front panel. Also shown is slot 28 in the rear panel. The left edge 40 of cutout 16 is to the right of the left edge 46 of cutout 22 and the right edge 42 of cutout 16 is to the left of the right edge 48 of cutout 22. Similarly, the bottom edge 17 of cutout 16 is above the bottom edge 23 of cutout 22 and the top edge 15 of cutout 16 is below the top edge 21 of cutout 22. Also of note is that the distance between the top edge 21 of cutout 22 and the top edge 15 of cutout 16 is larger than the distance between the bottom edge 17 of cutout 16 and the bottom edge 23 of cutout 22.

Also shown in FIG. 2 is the relative position and size of the slots 28 in the rear panel 24. The slots 28 are wider than the width of the cutouts in either the front or intermediate panels; however, the slots are much shorter in height than the cutouts. This is shown in FIG. 2, where the left edge 52 of slot 28 is shown to the left of the left edge 46 of cutout 22 and the right edge 54 of slot 28 is shown to the right of the right edge 48 of cutout 22. The top edge 27 of slot 28 is slightly below the top edge 21 of cutout 22 and the bottom edge 29 of slot 28 is below the top edge 15 of cutout 16.

With these relationships in position and size, display vaults 35 are formed by the front, intermediate and rear panels for holding baseball cards and similar objects. FIG. 5 is a vertical section of FIG. 2 showing how the difference in width between the cutouts in the intermediate panel and the cutouts in the front panel forms a display vault into which a baseball card can be placed. The baseball card is held sandwiched between the front and rear panel and can be viewed through the front panel.

FIG. 6 shows a horizontal section of FIG. 2. Here it can be seen that a baseball card or similar object can be inserted into a display vault 35 from the rear of the windowed matrix display through slot 28 in rear panel 24. The cutouts 16 are designed so that they are shorter and narrower than the baseball cards or similar objects to be displayed. This ensures that the baseball cards are framed by cutouts 16 in front panel 12. The cards are inserted until they touch the bottom edge 23 of cutout 22 in the intermediate panel. This ensures that the baseball cards are all aligned properly in the windowed matrix display and below the bottom edge 17 of cutout 16 for proper framing.

FIG. 3 is a view of a section of the windowed matrix display from the planar rear side 26 of the rear panel 24. FIG. 3 shows a baseball card 11 or similar object inserted into display vault 35. Here the relationships of the size of baseball card 11, cutout 16 in the front panel, cutout 22 in the intermediate panel and slot 28 in the rear panel are apparent. The baseball card's width is wider than cutout 16 in the front panel and less wide than cutout 22 in the intermediate panel. The baseball card 11 is inserted to the bottom edge 23 of cutout 22. This positions the bottom edge 17 of cutout 16 above the bottom 36 of the baseball card. The baseball card's height positions the top 37 of the baseball card above the top edge 15 of cutout 16 and below the top edge 27 of slot 28 and the top edge 21 of cutout 22.

The foregoing describes one preferred embodiment of the invention. One disadvantage of that embodiment is that the baseball cards or similar objects can only be viewed through the cutouts on the front panel, because the front, intermediate and rear panels are opaque. This means that important information on the rear of a baseball card cannot be viewed unless the baseball card is removed from its display vault. Another preferred embodiment of the invention has an opaque front panel 12, an intermediate rear panel 18 and a transparent rear panel 24. The opaque front and intermediate panels allow the front of the baseball cards to be displayed as before. The transparent rear panel allows the information on the rear of the baseball cards or similar objects to be visible. With this preferred embodiment, the statistics of the players of a whole baseball team can be viewed at once. Other flat objects similar the baseball cards may have similar information that is useful to be able to observe such as dates on photographs.

The features of the present invention which are believed to be novel are set forth with particularly in the appended claims.

Although the foregoing has been a description and illustration of a specific embodiment of the invention, various modifications and changes thereto can be made by persons skilled in the art without departing from the scope and spirit of the invention as defined by the following claims.

What is claimed is:

1. A windowed display for displaying baseball cards and similar flat objects that comprises:

a front panel having planar front and rear sides and having a matrix of rectangular cutouts which are smaller in area than the flat objects to be displayed; and an intermediate panel having planar front and rear sides and having a corresponding matrix of rectangular cutouts which are larger in area than said rectangular cutouts on said front panel and are larger in area than said flat objects to be displayed and wherein said planar front side of said intermediate panel is attached to said planar rear side of said front panel and aligned such that said matrix of rectangular cutouts on said front panel are entirely visible and centered horizontally and offset lower vertically with respect to said intermediate panel rectangular cutouts when viewed from said rear planar side of said intermediate panel and wherein there is a larger space between the top edges of said rectangular cutouts in said front panel and the top edges of said rectangular cutouts in said intermediate panel than the space between the bottom edges of said rectangular cutouts in said front panel and the bottom edges of said rectangular cutouts in said intermediate panel; and a rear panel having planar front and rear sides and having a corresponding matrix of rectangular slots wider and much shorter than the corresponding width and height of said rectangular cutouts on said intermediate panel and wherein said planar front side of said rear panel is attached to said planar rear side of said intermediate panel and aligned such that said top edges of said rectangular cutouts of said intermediate panel are above the bottom edges of said rectangular slots; and wherein said front, intermediate and rear panels are attached to one another to form a matrix of display vaults that can be filled by inserting flat objects through said slots in said rear panel; and wherein said flat objects are viewable from said front side of said front panel through said rectangular cutouts in said front panel; and wherein said intermediate panel is slightly thicker than said flat objects which are to be inserted into said windowed display; and wherein the relative dimensions between said flat objects to be displayed and said rectangular cutouts in said front and said intermediate panels are such that said flat objects are snugly aligned in said matrix of display vaults.

2. The windowed display for baseball cards and similar objects of claim 1, wherein:

said front and intermediate panels are made of opaque material and said rear panel is made of a transparent material for the purpose of allowing the front sides of said flat objects to be viewed as framed from the front of said front panel and also for the purpose of allowing the rear side of said flat objects to be viewed from said rear side of said rear panel through said transparent material.

3. The windowed display for baseball cards and similar objects of claim 1 or 2, wherein:

said matrix of rectangular cutouts in said front and intermediate panels and said matrix of rectangular slots in said rear panel consists of 4 horizontal rows by 7 vertical columns.

* * * * *